US005177822A

United States Patent [19]

Kassai

[11] Patent Number: 5,177,822

[45] Date of Patent: Jan. 12, 1993

[54] BED APPARATUS

[75] Inventor: Kenzou Kassai, Osaka, Japan

[73] Assignee: Aprica Kassai Kabushikikaisha, Osaka, Japan

[21] Appl. No.: 755,448

[22] Filed: Sep. 5, 1991

[30] Foreign Application Priority Data

Sep. 14, 1990 [JP] Japan ..... 2-245249

[51] Int. Cl.[5] ..... A61G 7/00; A61G 7/14

[52] U.S. Cl. ..... 5/612; 5/81.1; 5/83.1

[58] Field of Search ..... 5/600, 612, 81.1, 83.1, 5/84.1

[56] References Cited

U.S. PATENT DOCUMENTS 2,125,546 8/1938 Corr ..... 5/86.1
4,262,375 4/1981 Lilienthal ..... 5/81.1

FOREIGN PATENT DOCUMENTS 0110851 6/1984 European Pat. Off. .
2-215462 8/1990 Japan ..... 5/612

OTHER PUBLICATIONS

Patent Abstracts of Japan, Publication No.: 02215462, Publication Date: Nov. 15, 1990.

*Primary Examiner*—Alexander Grosz
*Attorney, Agent, or Firm*—W. G. Fasse

[57] ABSTRACT

A pair of sliders (4, 5) are mounted on both end portions of a bed body (3) for sliding along said end portions in the cross direction of the bed body (3). Upright bars (6, 7) are mounted on the respective sliders (4, 5) to upwardly extend from the sliders (4, 5). Support members (8, 9) mounted on the respective upright bars (6, 7) are movable along the upright bars (6, 7) and stoppable at adjusted positions. Two parallel side bars (10, 11) couple the support members (8, 9) of a pair with each other. The respective upright bars (6, 7) are movable with respect to the sliders (4, 5) along the cross direction of the bed body (3), whereby the upright bars (6, 7) can be moved to ends of the sliders (4, 5) when the sliders extend laterally from the bed body (3) and outside the bed body (3). As the result, the bed body (3) will not hinder any nursing of a sick person or the like, who is held by the side bars (10, 11) and can be attended at the side of the bed body (3).

14 Claims, 13 Drawing Sheets

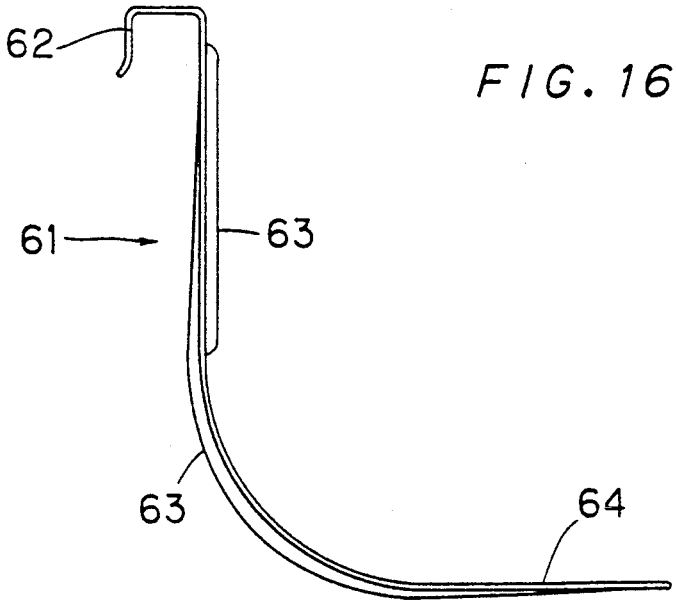
FIG. 16
FIG. 17
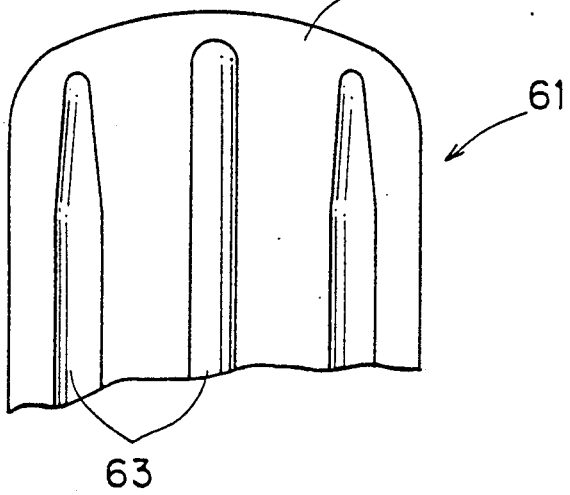
FIG. 18
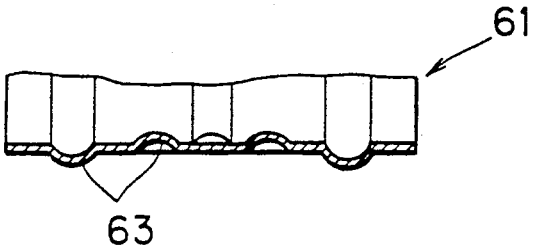

BED APPARATUS

FIELD OF THE INVENTION

The present invention relates to a bed apparatus which is suitable for nursing a sick, physically handicapped or bed-ridden person (hereinafter simply referred to as "sick person or the like"), and more particularly, it relates to a bed apparatus which can be easily applied to home use with a capability for a wide range of operation modes.

BACKGROUND INFORMATION

Medical equipment includes nursing apparatuses combined with beds, capable of various functions.

Japanese Patent Application No. 1-38682, which was filed on Feb. 17, 1989 corresponding to Japanese Patent Publication 2-215,462, laid open on Aug. 28, 1990, discloses an improved bed apparatus. Considering the housing circumstances in Japan, the known bed apparatus can be used in a narrow room such as a 6-mat room (about 360 cm×270 cm) or a 4.5-mat room (about 270 cm×270 cm), for example, and is provided with features for easily laying or taking down a sick person or the like on or from a bed body. Further, this bed apparatus is devised to be of help for rehabilitation of a sick person or the like.

The aforementioned bed apparatus comprises a pair of guides, which are fixedly provided on both end portions along the longitudinal direction of the bed body and extend in the cross direction of the bed body. A pair of sliders is mounted to slide along these guides in the cross direction of the bed body. The sliders slide outwardly along the guides outwardly and extend from side portions of the bed body. Upright bars are fixedly mounted on the sliders respectively, to upwardly extend from the sliders. Support members are mounted to be movable along the upright bars. Stops are provided to stop the support members at arbitrary positions along the upright bars.

In the aforementioned bed apparatus, the pair of upright bars are movable between positions within and out of the cross-directional dimension of the bed body, in response to the sliding movement of the sliders along the guides. The support members are vertically movable along the upright bars and stoppable in any desired position, independently of the positions of the upright bars. Consequently, the pair of support members can be located at any arbitrary positions within a range of a space above the bed body and to the side of the bed.

Thus, it is possible to move a sick person or the like from the bed body, to a side portion of the bed body and vice versa, by the movement of the support members. According to this bed apparatus, therefore, it is possible to easily take the sick person or the like down from the bed body for bathing or helping movement into a wheelchair, and vice versa.

In order to move the sick person or the like as described above, two parallel side bars, for example, are interconnecting the pair of support members with each other, so that the sick person or the like is laid between the side bars. Appropriate hanger members, which are laid under the body of the sick person or the like, are hung on the side bars. The side bars extending across the pair of support members are capable of suspending various configurations or structures of hanger members. Thus, it is possible to move the sick person or the like in any desired condition such as a lying or sitting condition, by selecting appropriate types of hanger members.

The aforementioned sliders are preferably kept within the cross-directional dimension of the bed body to the utmost, when the same are not in laterally extending positions. Thus, the lengths of the sliders along the cross direction of the bed body must be substantially equal to or shorter than the cross-directional dimension of the bed body, whereby, the sliders cannot extend from the bed body to an extent exceeding the cross-directional dimension of the bed body even if the same projects most from the bed body.

On the other hand, the upright bars are fixedly mounted on the sliders, as hereinabove described. These upright bars are adapted to vertically and movably guide the support members holding the side bars. The side bars are adapted to hold the hanger members for carrying the sick person or the like. In order to enable the carriage of the sick person or the like who is lying on the bed body, the side bars must be locatable substantially at central positions along the cross direction of the bed body, and the support members as well as the upright bars must responsively be locatable at substantially central positions of the bed body.

In order to enable movement of the sick person or the like who is carried by the hanger members to a position sidewardly displaced from the bed body, the side bars, the support members and the upright bars must be sidewardly movable beyond the range of the cross-directional dimension of the bed body.

As hereinabove described, particularly the range of movement of the upright bars is provided by the sliding operation of the sliders. The upright bars are most typically located at substantially central positions along the cross direction of the bed body when the sliders are retracted with respect to the bed body, while the same are located at the side of the bed body when the sliders extend laterally as much as possible from the bed body.

According to the aforementioned structure, however, it is impossible to sufficiently displace the upright bars laterally away from the bed body, since the upright bars are fixedly mounted on the sliders. More specifically the lengths of the sliders are increased to be substantially equal to the cross-directional dimension of the bed body so that the sliders extend laterally from the bed body by dimensions substantially equal to the cross-directional dimension of the bed body, at the maximum possible extension for the sliders. On the other hand, the upright bars must be mounted in substantially central positions along the longitudinal directions of the sliders, so that the upright bars can be located at substantially central positions along the cross direction of the bed body. Thus, the upright bars cannot be moved laterally beyond half the cross-directional dimension of the bed body even if the lengths of the sliders are maximized. To this end, the bed body itself may hinder nursing of the sick person or the like at the side of the bed body.

SUMMARY OF THE INVENTION

Accordingly, it is an object of the present invention to provide a bed apparatus, which permits sufficiently moving the upright bars to the side of the bed body without increasing the cross-directional dimension of the bed body and longitudinal dimensions of the sliders.

The bed apparatus according to the present invention comprises a bed body which has longitudinal and cross-directional dimensions. A pair of sliders is slidably mounted on this bed body. The pair of sliders is slidable along the cross direction of the bed body on both end portions along or parallel to the direction of the bed body, to extend in the direction of the bed body. Upright bars are mounted on the sliders respectively, to extend upwardly from the sliders. Support members are mounted on the upright bars to be movable or adjustable along the upright bars and stoppable in adjusted positions. Coupling bar means, such as the aforementioned two side bars, are provided to couple the pair of support members with each other.

In the bed apparatus according to the present invention, the upright bars are movable along the sliders crosswis to the length of the bed, whereby it is possible to move the upright bars to ends of the sliders extending from the bed body, to a position outside the bed body.

According to the present invention it is possible to sufficiently move the upright bars to the side of the bed body effectively through the sliding ranges of the sliders.

Thus, the bed body itself will not hinder nursing of the sick person or the like, who is moved laterally from the bed body to the side of the bed body.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 16 is a side elevational view showing the hanger member of FIG. 15;

FIG. 17 is a plan view partially showing the hanger member;

FIG. 18 is a sectional view taken along the line XVIII—XVIII in FIG. 15;

DESCRIPTION OF THE PREFERRED EMBODIMENTS

Figure 1:
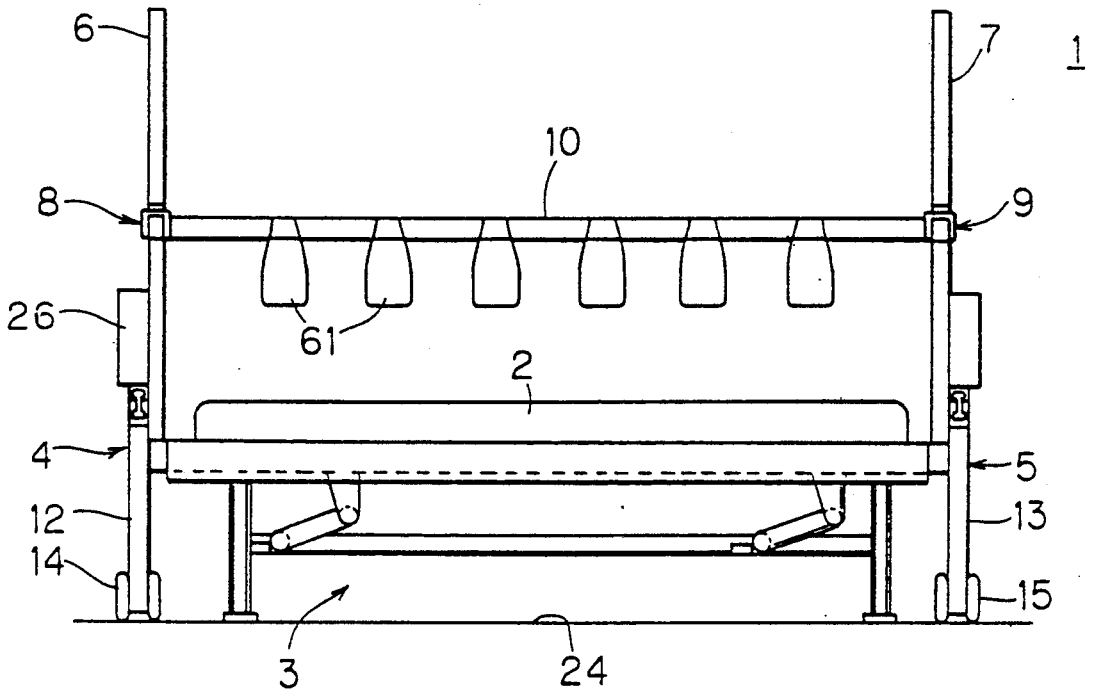
FIG. 1 is a front elevational view showing a bed apparatus according to an embodiment of the present invention.
Figure 2:
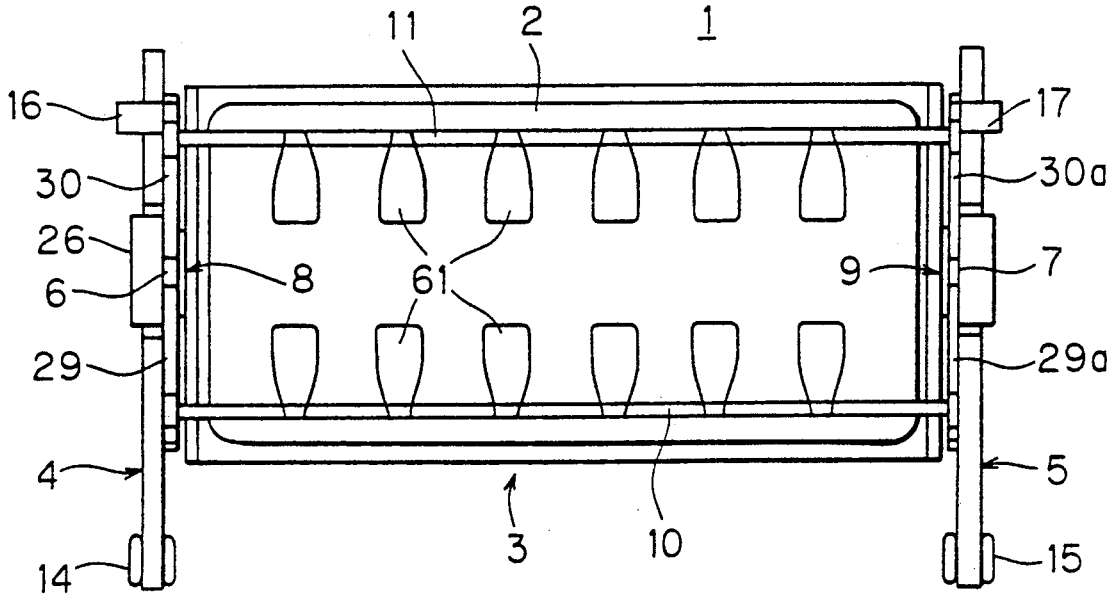
FIG. 2 is a plan view of the bed apparatus shown in FIG. 1.
Figure 3:
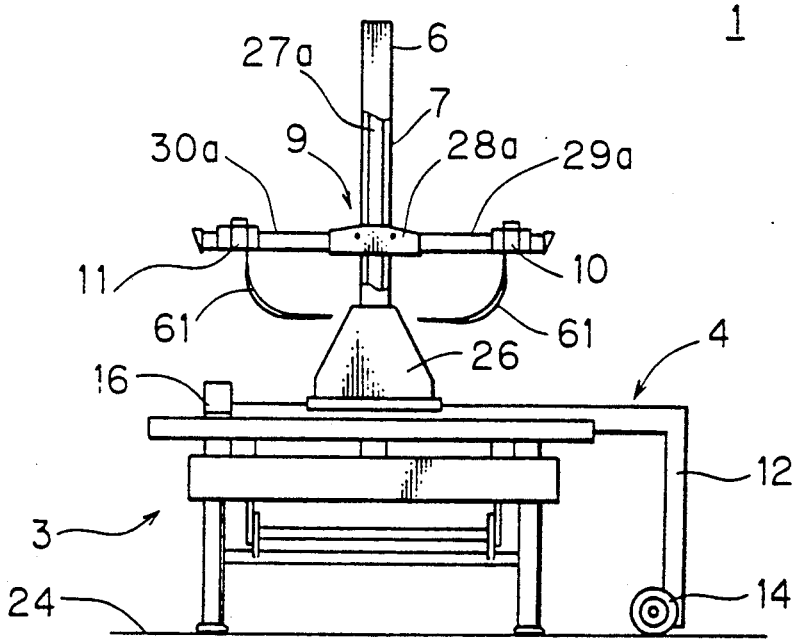
FIG. 3 is a left end elevational view of the bed apparatus shown in FIG. 1.
Figure 4:
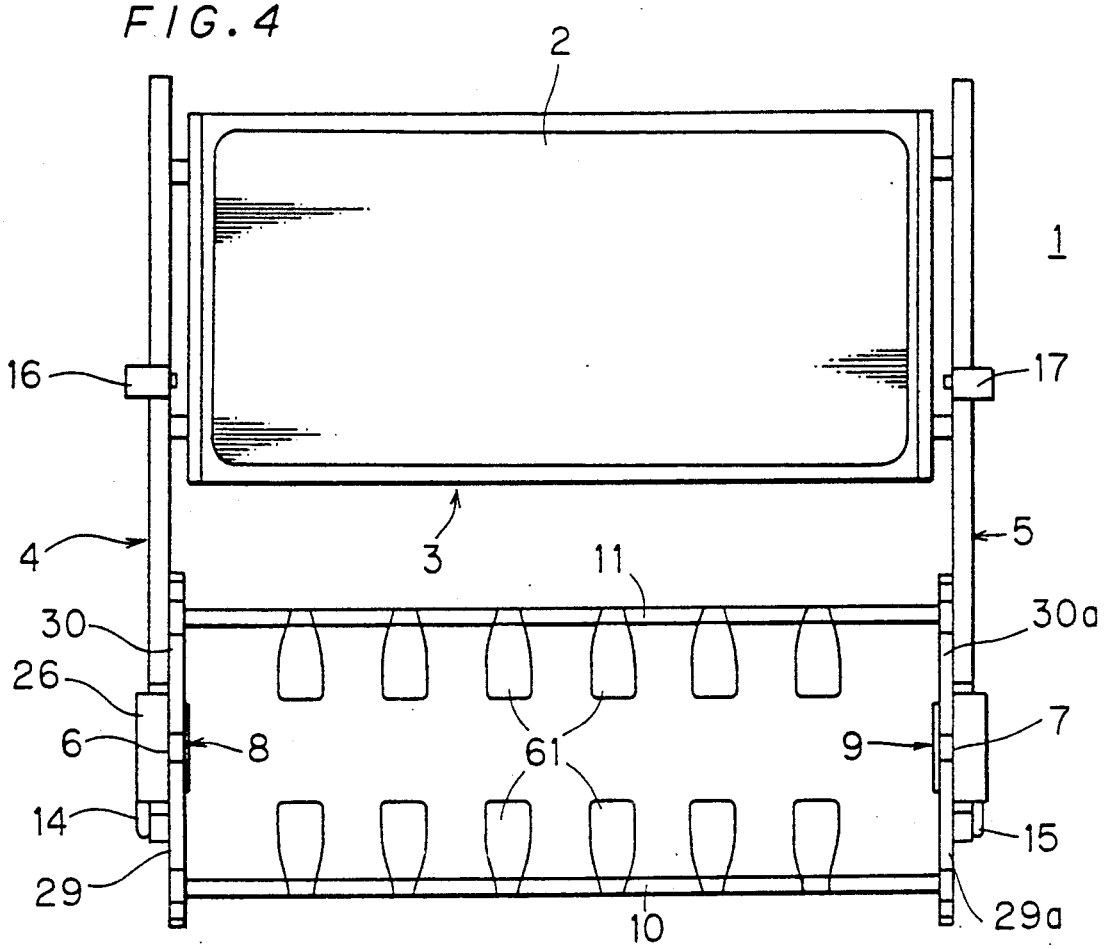
FIG. 4 is a plan view as in FIG. 2, however showing sliders in their most extended position laterally outside the bed body 3.
Figure 5:
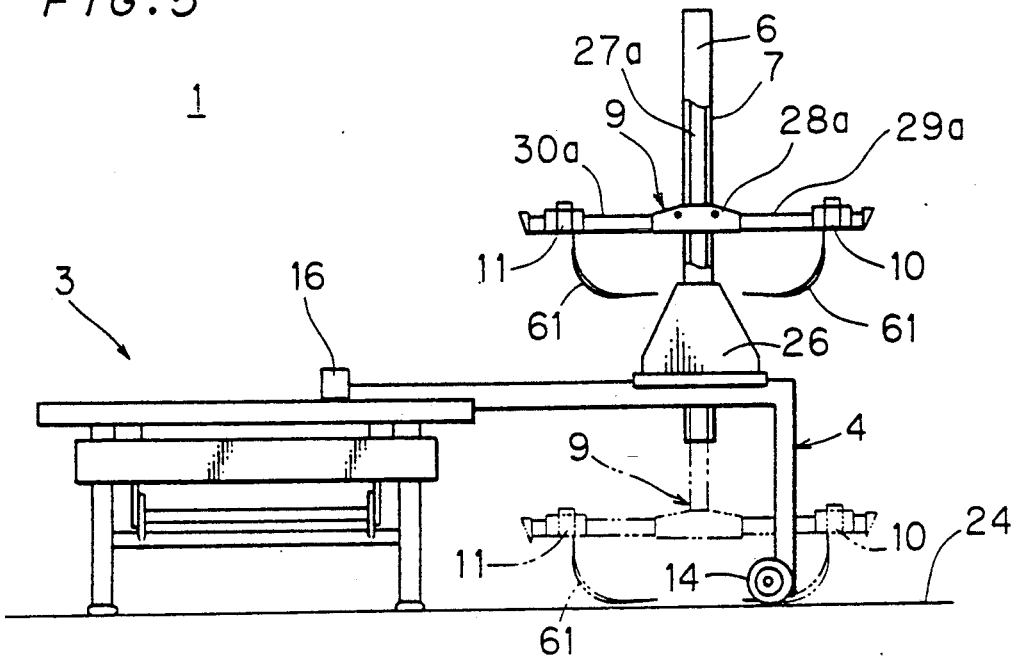
FIG. 5 is a left end elevational view as in to FIG. 3, but showing the laterally extended state shown in FIG. 4.
Figure 6:
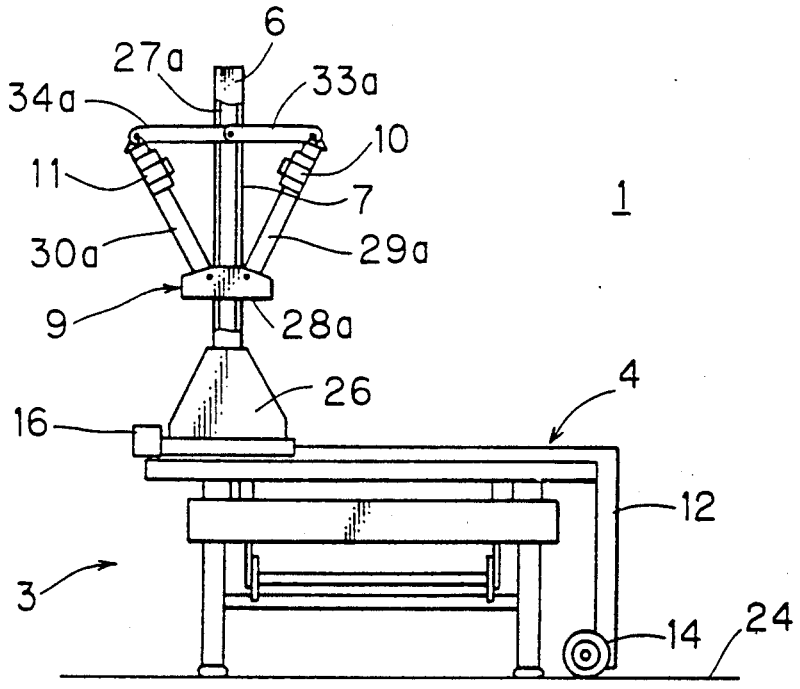
FIG. 6 is a left side elevational view by in FIG. 3, but showing the sliders in their most retracted position with respect to the bed body.

FIGS. 1 to 6 show the overall structure of a bed apparatus 1 according to an embodiment of the present invention. FIGS. 1 to 3 show a first typical operational mode of the bed apparatus 1 and FIGS. 4 and 5 show a second typical operational mode thereof, while FIG. 6 shows a third typical operational mode of the bed apparatus 1. FIG. 1 is a front elevational view, FIGS. 2 and 4 are plan views, and FIGS. 3, 5 and 6 are left side end elevational views respectively.

Figure 19:
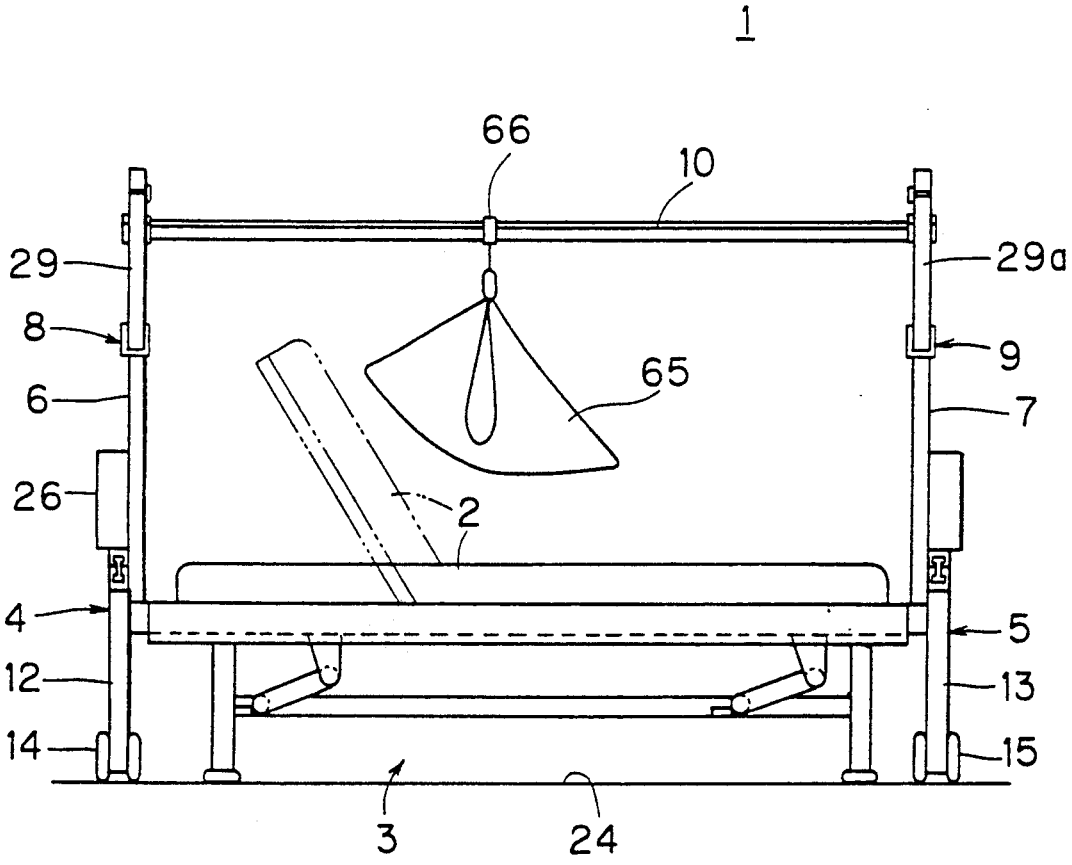
FIG. 19 is a front elevational view corresponding to FIG. 1, showing a hammock which is used in place of the hanger member.

The bed apparatus 1 comprises a bed body 3 and a mattress 2 which is spread thereon. The bed body 3 is so hinged that it is possible to arbitrarily change a partially inclined state of the mattress 2. As described below, FIG. 19 shows a partially raised state of the mattress 2, with phantom lines.

A pair of sliders 4 and 5 is mounted on both end portions of the bed body 3, to be slidable in the cross direction of the bed body 3. The sliding movement enables the sliders 4 and 5 to extend in the cross direction of the bed body 3, as most clearly shown in FIGS. 4 and 5.

A pair of upright bars 6 and 7 by mounted to upwardly extend from the sliders 4 and 5 respectively.

A pair of support members 8 and 9 are mounted to be movable along the upright bars 6 and 7 respectively and stoppable at adjusted positions.

Two parallel side bars 10 and 11 are provided to couple the pair of support members 8 and 9 with each other.

The bed apparatus 1 will now be described in more detail.

Figure 7:
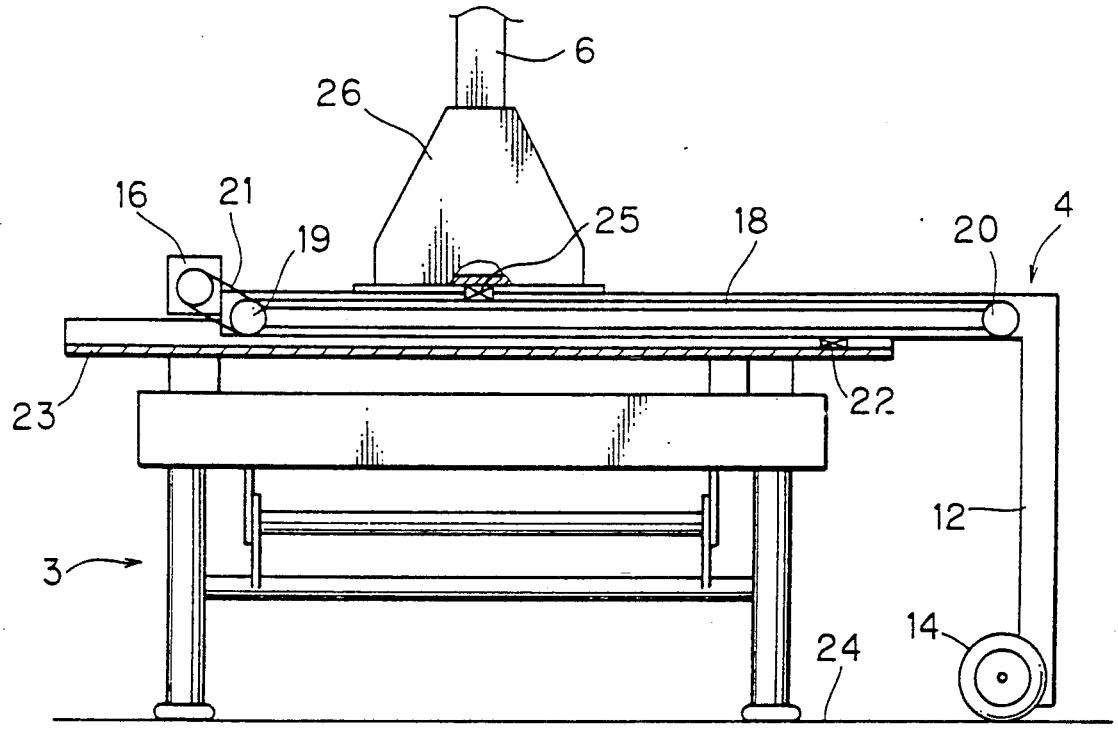
FIG. 7 is a left end elevational view as in FIG. 3, but showing a mechanism for sliding the slider cross-wise to the bed body.
Figure 8:
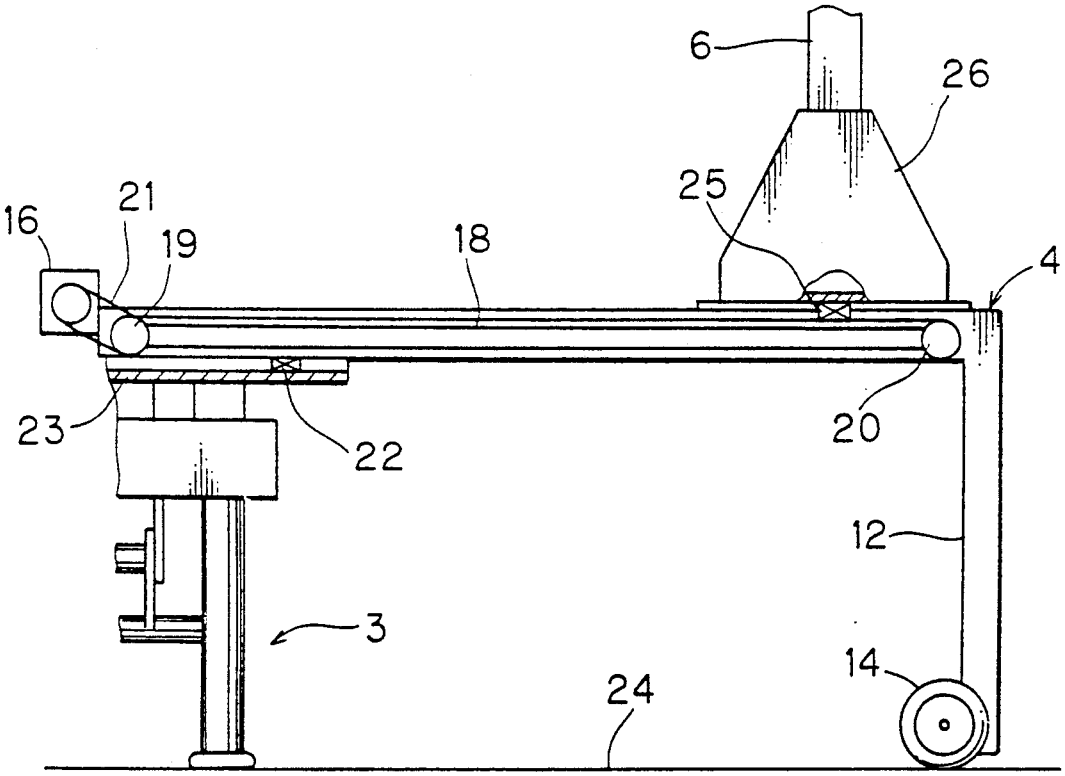
FIG. 8 is a left end elevational view similar to FIG. 5, but showing the mechanism of FIG. 7 in its most extended position.
Figure 9:
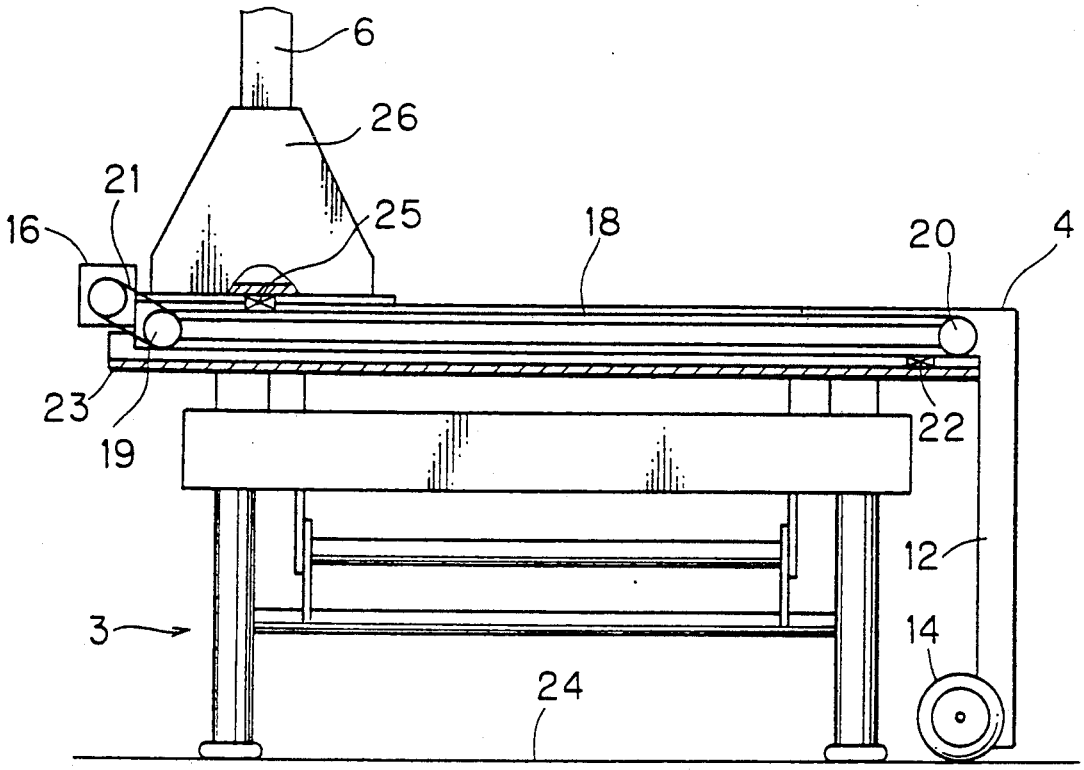
FIG. 9 is a left end elevational view as in FIG. 6, but showing the mechanism of FIG. 7 in its most retracted position.

First, a structure for shifting the 4 or 5 slide along the cross direction of the bed body 3 will be described. FIGS. 7, 8 and 9, which correspond to FIGS. 3, 5 and 6 respectively, show the first slider 4. The second slider 5 has a structure which is substantially identical to that for the first slider 4. It is noted here that FIGS. 7 to 9 are partially fragmented or simplified, in order to facilitate the understanding of the operation of the slider 4.

The sliders 4 and 5, having L-shaped configurations as a whole, are provided with vertically extending leg portions 12 and 13 respectively. Wheels 14 and 15 are mounted to the lower ends of the leg portions 12 and 13 respectively.

The sliders 4 and 5 are driven by traverse motors 16 and 17, which are fixed to the sliders 4 and 5 respectively.

Referring specifically to FIGS. 7 to 9, the structure for driving the first slider 4 will now be described. According to this embodiment, the upright bar 6 moves along the slider 4 in response to a sliding movement of the slider 4.

For this purpose chain 18 is arranged on a horizontally extending portion of the slider 4. The chain 18 may be replaced by a belt or the like. The chain 18 extends around sprocket wheels 19 and 20, mounted on the slider 4. Rotation of an output shaft of the motor 16 is transmitted to the first sprocket wheel 19 through a belt 21, for example.

A fixture 22 is fixed to a guide rail 23 in a prescribed position on a lower path for the chain 18. The guide rail 23 is secured to the bed body 3.

When the drive of the motor 16 is transmitted to the sprocket wheel 19 through the belt 21 and the chain 18 circulates in response, therefore, the slider 4 slides along the guide rail 23 since the lower path for the chain 18 is determined by the guide 23 through the fixture 22. The sliding direction of the slider 4 can be varied with the direction of rotation of the output shaft of the motor 16. In such sliding movement of the slider 4, the wheel 14 rolls on a floor 24.

Another fixture 25 is fixed to a base portion 26 of the upright bar 6 in a prescribed position on an upper path for the chain 18.

When the chain 18 circulates in the aforementioned manner, therefore, the base portion 26 and with it the upright bar 6 are displaced along the slider 4, since the upper path for the chain 18 is fixed to the base portion 26 by the fixture 25.

When the slider 4 slides along the bed body 3, therefore, the upright bar 6 is displaced in the same direction on the slider 4. In this case, the amount of displacement of the slider 4 with respect to the bed body 3 is equal to that of the upright bar 6 with respect to the slider 4.

In the state shown in FIG. 7, the upright bar 6 is located at the cross-directional center of the bed body 3. In this state, the slider 4 is slightly laterally spaced from the bed body 3.

When the slider 4 extends maximally laterally outwardly from the bed body 3 as shown in FIG. 8, the upright bar 6 is brought into a position close to the leg portion 12 on the slider 4. Relative to the bed body 3, the upright bar 6 is displaced by an amount twice that of the slider 4. Thus, it is possible to sufficiently and laterally separate the upright bar 6 from the bed body 3 while reducing the amount of extension of the slider 4 from the bed body 3.

When the legs 12 of the slider 4 are moved still closer to the bed body 3 as shown in FIG. 9, from the state of FIG. 7, the upright bar 6 is brought into a position close to the motor 16 on the slider 4. As a result, the upright bar 6 is moved across the bed toward a side portion along the of the bed body 3. Movement of the slider 4 and bar 6 into the position shown in FIG. 9 is generally implemented when the aforementioned side bars 10 and 11 are not used for protecting the sick person or the like, who lies on the bed body 3, against contact with the side bars 10 and 11.

Figure 10:
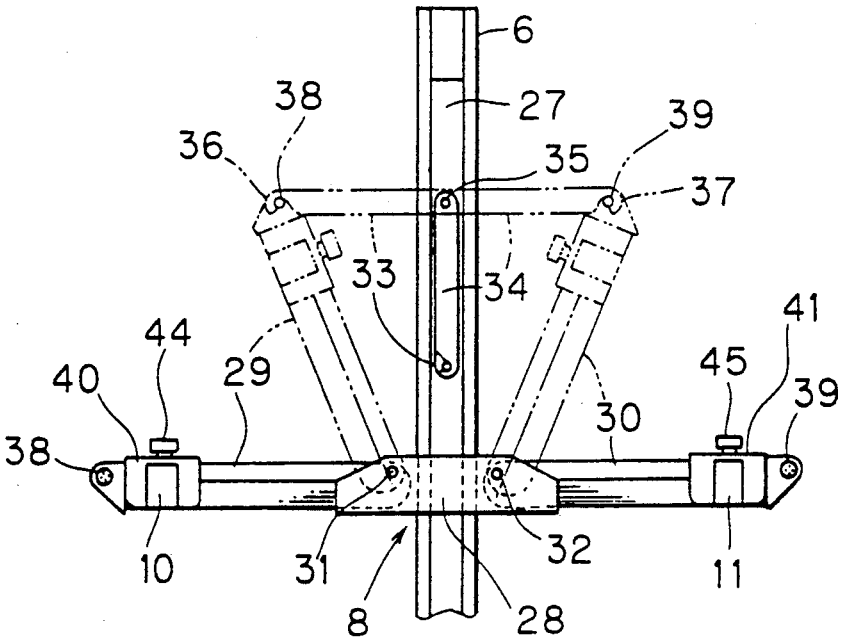
FIG. 10 is a right end elevational view, in the longitudinal bed direction, showing the structure of a support member.
Figure 11:
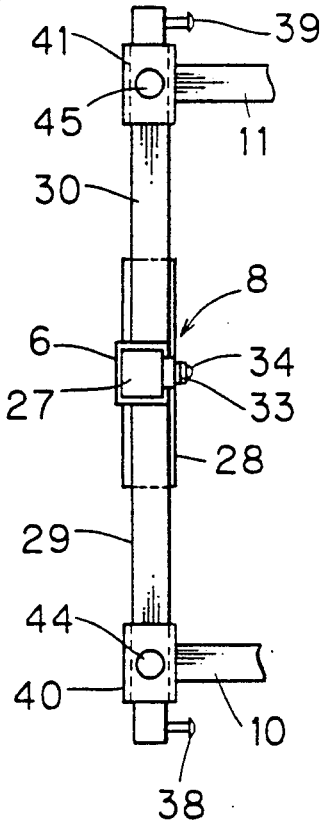
FIG. 11 is a plan view, vertically downwardly, showing the structure of the support member.
Figure 12:
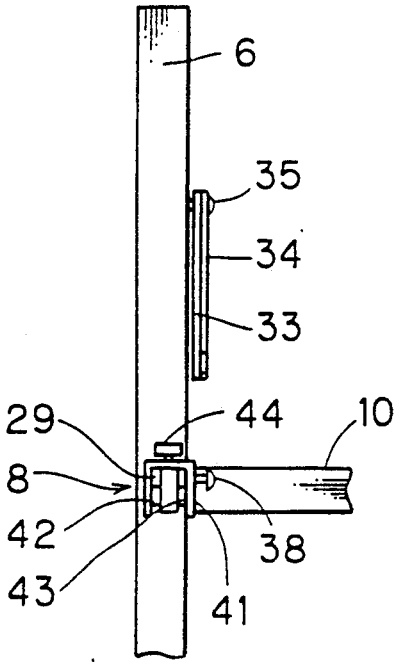
FIG. 12 is a front elevational view, in the direction cross-wise of the bed, showing the structure of the support member.

The structure of the support member 8 or 9 for the side bars 10, 11 will now be described in detail. The support members 8 and 9 are symmetrical in structure to each other. FIG. 10 is a right side elevational view showing the first support member 8, FIG. 11 is a plan view thereof, and FIG. 12 is a front elevational view of the support member 8, respectively.

Figure 13:
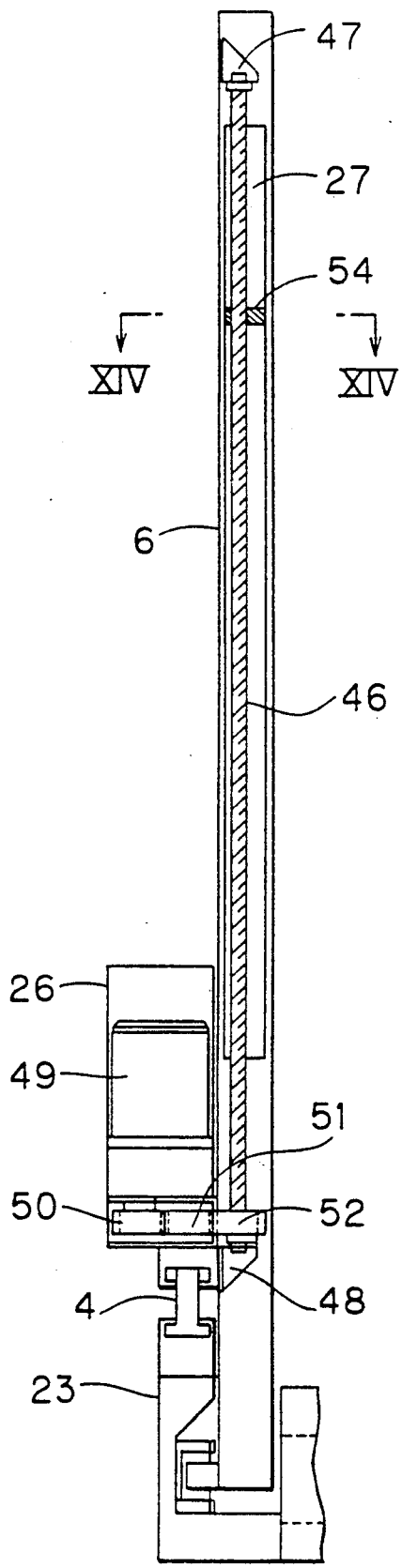
FIG. 13 is a longitudinal sectional view showing the relationship between a sliding block, which is included in the support member, and an upright member related thereto.
Figure 14:
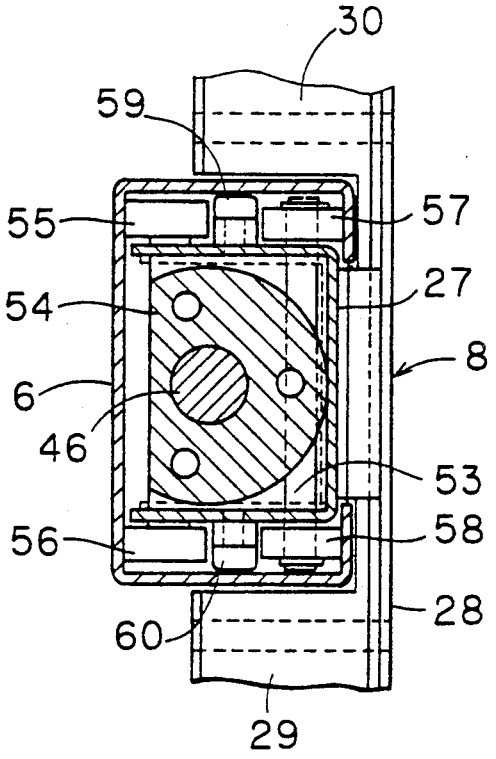
FIG. 14 is an enlarged sectional view taken along the line XIV—XIV in FIG. 13.

The support member 8 comprises a sliding block 27 which moves along the respective upright bar 6. The relationship between the sliding block 27 and the upright bar 6 will be described below with reference to FIGS. 13 and 14. A bracket 28 having a U-shaped section, for example, is fixed to the sliding block 27. This bracket 28 is also shown in FIG. 14, as described below. A pair of arms 29 and 30 are mounted on the bracket 28. These arms 30 and 29 are pivoted by pins 31 and 32 to the bracket 28 along the cross direction of the bed body 3 on opposite sides of the bar 6.

As shown by phantom lines in FIG. 10, the arms 29 and 30 are rotatable about the pivot pins 31 and 32 relative to the bracket 28. Further, the sliding block 27 rotatably holds two hook lines 33 and 34 by a common journal pin 35. Hook portions 36 and 37 are provided on respective free ends of the hook links 33 and 34. On the other hand, engaging pins 38 and 39, which are engageable with the hook portions 36 and 37 respectively, are provided on respective free ends of the arms 29 and 30. When the arms 29 and 30 are upwardly rotated as shown by phantom lines in FIG. 10, the hook portions 36 and 37 of the hook links 33 and 34 engage with the engaging pins 38 and 39 respectively, to hold the arms 29 and 30 in the upwardly rotated states.

The aforementioned two side bars 10 and 11 are mounted on the arms 29 and 30 respectively. Thus, the side bars 10 and 11 can be located at upper and lower positions, following the aforementioned rotation of the arms 29 and 30. FIG. 10 shows the lower and upper positions of the side bars 10 and 11 with solid and phantom lines. FIG. 6 shows a state corresponding to the state shown by the phantom lines in FIG. 10. The side bars 10 and 11 are thus brought into the upper positions to protect the sick person or the like, who is laid on the bed body 3, against injury, as well as to facilitate medical examination of the sick person or the like with no hindrance. Further, it is also possible to implement another operational mode as described below with reference to FIG. 19, by bringing the side bars 10 and 11 to the upper positions as shown by the phantom lines in FIG. 10.

While FIGS. 10 to 12 show a structure which is related to the first support member 8, FIGS. 1 to 6 and FIG. 19 show the second support member 9. Elements of the second support member 9 which are in laterally symmetrical positions with respect to those included in the first support member 8, are denoted by the same reference numerals as shown in FIGS. 10 to 12 with subscripts "a", to avoid a redundant description.

According to this embodiment, the positions of the side bars 10 and 11 are changeable on the arms 29, **29*a*, 30 and 30*a*. As to the relationship between the arms 29 and 30 and the side bars 10 and 11 shown in FIGS. 10 to 12, clamps 40 and 41 having inverted U-shaped sections are mounted on respective end portions of the side bars 10 and 11. On the other hand, the arms 29 and 30 have T-shaped sections. Further, guide blocks 42 and 43 for holding lower portions of the arms 29 and 30 having the T-shaped sections, are mounted on the clamps 40 and 41, as shown in FIG. 12 with reference to the clamp 40. Thus, the clamps 40 and 41, which are longitudinally movable along the arms 29 and 30, are inhibited against a lateral displacement relative to the arms 29 and 30. The clamps 40 and 41** are provided with clamp screws 44 and 45 respectively. These clamp screws 44 and 45 are tightened for fixing the positions of the clamps 40 and 41 on the arms 29 and 30.

The aforementioned structure is also employed on the other ends of the side bars 10 and 11 respectively.

Thus, the distance between the pair of side bars 10 and 11 can be varied with the positions of the side bars 10 and 11 relative to the arms 29 and 30. For example, the distance between the side bars 10 and 11 shown in FIG. 2 is wider than that shown in FIG. 4. The distance between the side bars 10 and 11 is thus changed in response to the physical constitution of the sick person or the like, for example, as described below.

A structure for moving the support member 8 or 9 along the upright bar 6 or 7 and for holding the support members 8, 9 in an adjusted position, will now be described. FIG. 13 is a longitudinal sectional view showing the relationship between the sliding block 27 which is included in the first support member 8 and the related upright bar 6. FIG. 14 is an enlarged sectional view taken along the line XIV—XIV in FIG. 13. The relationship between the sliding block 27*a* which is secured to the second support member 9, and the upright bar 7 involves a structure (not shown) which is symmetrical to that shown in FIGS. 13 and 14. Therefore, only the relationship between the sliding block 27 which is secured to the first support member 8 and the related upright bar 6, is described in detail.

Referring to FIGS. 13 and 14, the upright bar 6 has a C-shaped section, in order to receive the sliding block 27 and to enable the mounting of the bracket 28 (FIG. 14) on the sliding block 27. A lead screw 46 is arranged in the upright bar 6, to be rotatable about its central axis. FIG. 13 shows brackets 47 and 48 for rotatably mounting both ends of the lead screw 46.

The aforementioned base portion 26 of the upright bar 6 has a hollow structure, to contain a motor 49 for driving the vertical movement of the sliding block 27. The motor 49 has a shaft rotatable in one or the opposite direction. Rotation of the shaft of the motor 49 is transmitted to the lead screw 46 through gears 50, 51 and 52.

A nut or screw block 54 with a female threading is fixed to the sliding block 27 through a mounting plate 53. The female threading of the nut screw block 54 engages the lead screw 46. When the lead screw 46 is driven by the motor 49, the sliding block 27 is moved vertically. When the motor 49 is stopped, on the other hand, the lead screw 46 is also stopped so that it is impossible to transmit a driving force from the screw block 54 to the lead screw 46, whereby the sliding block 27 is held in its adjusted position by the stoppage of the lead screw 46.

FIG. 14 shows the elements for smoothly guiding the movement of the sliding block 27 along the upright bar 6. A plurality of rotatable guide rollers 55, 56, 57 and 58 and guide shoes 59 and 60 are provided on the sliding block 27. The guide rollers 55 to 58 and the guide shoes 59 and 60 come into contact with the inner surface of the upright bar 6 from various directions, thereby facilitating a smooth vertical movement of the sliding block 27 within the upright bar 6.

Although FIG. 14 shows four guide rollers 55 to 58 and two guide shoes 59 and 60, appropriate numbers of such guide rollers and guide shoes (not shown) may be vertically distributed along the sliding block 27.

The support member 8, more specifically the bracket 28 (not shown in FIG. 13), is mounted on the lower end of the sliding block 27. The lower end of the sliding block 27 is movable to project downwardly from the upright bar 6 beyond the gear 52 and the lower end of the upright bar 6. Thus, the support member 8 or 9, can be brought to a level below the bed surface as shown by phantom lines in FIG. 5.

FIGS. 1 to 5 illustrate appropriate numbers of hanger members 61, which are provided on the side bars 10 and 11 respectively. These hanger members 61 are adapted to raise the sick person or the like in a lying condition. FIGS. 15 to 18 show the structure of each such hanger member 61 in detail.

Figure 15:
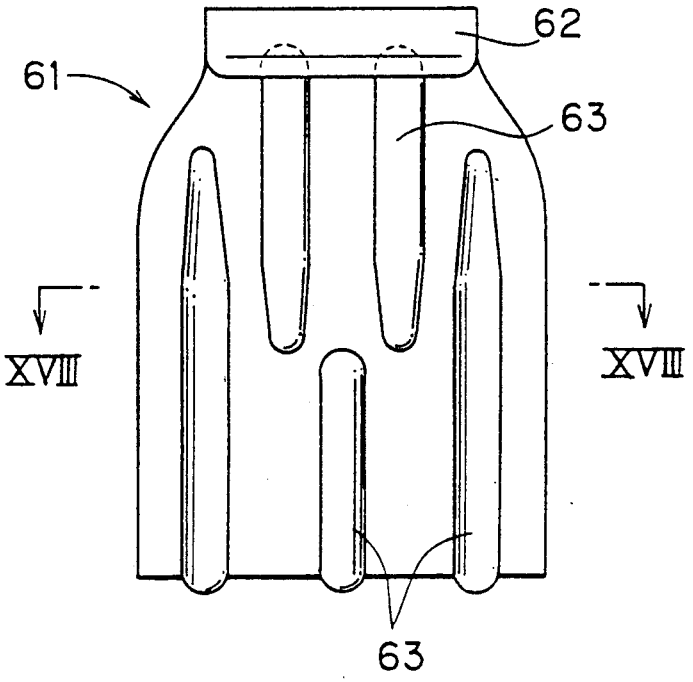
FIG. 15 is a front elevational view showing a hanger member for supporting a person.

FIG. 15 is a front elevational view showing the hanger member 61 and FIG. 16 is a right side elevational view thereof, while FIG. 17 is a plan view partially showing the hanger member 61, and FIG. 18 is a sectional view taken along the line XVIII—XVIII in FIG. 15.

The hanger member 61 is formed of a relatively rigid material such as hard plastic, aluminum or stainless steel, for example. The hanger member 61 is curved to provide an L-shaped configuration as a whole, and provided with a hook portion 62, which is engageable with the side bar 10 or 11, on its one end. A plurality of ribs 63 are distributed on the hanger member 61, in order to ensure at least a prescribed level of strength while reducing the thickness as well as the weight of the hanger member 61. As clearly shown in FIG. 18, such ribs 63 are preferably formed to provide rounded sections..

A plurality of hanger members 61 is arranged along the side bars 10, 11. In operation, horizontally extending bottom portions 64 of the hanger members 61 are inserted under the body of the sick person or the like, who is lying on the bed body 3. The hanger members 61 are appropriately distributed on both sides of the body of the sick person or the like in consideration of the weight of the sick person or the like. On the other hand, the height of and the distance between the side bars 10 and 11 are adjusted by means of the aforementioned mechanism with reference to the positions of the hook portions 62 of the hanger members 61. Then, the hook portions 62 of the hanger members 61 are engaged with the slide bars 10 and 11.

The aforementioned hanger members 61 can be advantageously inserted under the body of the sick person or the like, without raising the person. After the hook portions 62 of the hanger members 61 engage the side bars 10 and 11, the side bars 10 and 11 are so displaced that it is possible to move the sick person or the like to a desired position.

FIG. 19 shows a hammock 65, which is used for raising the sick person or the like in place of the aforementioned hanger members 61.

The hammock 65 is made of thick cloth or the like as a whole, in a configuration for enclosing the sick person or the like in a sitting condition. The hammock 65 is suspended from the side bars 10 and 11 by a suspender 66.

In the state shown in FIG. 19, the arms 29, 30, 29*a* and 30*a* are fixed in upwardly rotated states, so that the side bars 10 and 11 reach to a sufficient height for using the hammock 65, which encloses the sick person or the like in a sitting condition.

The hammock 65 is preferably used when the illness of the sick person or the like is relatively slight. In order to enclose the sick person or the like with the hammock 65, it is preferable to first bring the sick person or the like into a sitting position. If the bed body 3 is hinged, the mattress 2 is partially raised up as shown in phantom lines in FIG. 19 to bring the sick person or the like into a sitting position, thereby reducing the burden on the nurse.

Typical operational states of the present bed apparatus 1 will now be described with reference to FIGS. 1 to 6.

When the sliders 4 and 5 and the upright bars 6 and 7 are in the states shown in FIGS. 1 to 3, the sick person or the like who is lying on the bed body 3, is raised. The support members 8 and 9 and the side bars 10 and 11 are moved downwardly from the states shown in FIGS. 1 to 3, to positions engageable with the hook portions 62 of the hanger members 61, which have been inserted under the body of the sick person or the like. Further, the distance between the pair of side bars 10 and 11 is adjusted with due regard to the physical constitution of the sick person or the like. This distance need to be adjusted only once in an initial stage of use of the bed apparatus 1.

Then, the support members 8 and 9 and the side bars 10 and 11 are displaced upwardly to such positions that the hanger members 61 are separated from the mattress 2 on the bed body 3.

A bed sheet or the like, which is spread on the mattress 2, may be exchanged in this state, and the bed apparatus 1 may be returned to its original state after such an exchange.

Moving a sick person or the like from the bed body 3 to a position laterally next to the bed for bathing the person, for example, will now be described.

In this case, the sliders 4 and 5 are extended laterally from the bed body 3, as shown in FIGS. 4 and 5, whereby the sick person or the like is moved laterally from the bed body 3 at the same level as the bed surface.

Then, the support members 8 and 9 and the side bars 10 and 11 are moved downwardly, whereby the sick person is moved downwardly along the side of the bed body 3. This embodiment is so constructed that the support members 8 and 9 can be moved downwardly to bring the sick person or the like into contact with the floor 24, as shown by phantom lines in FIG. 5. The sick person or the like thus placed on the floor 24 is then brought into a bathtub for bathing.

In the state shown in FIGS. 4 and 5, the vertical positions for stopping the support members 8 and 9 may be selected in response to the type of care needed for the sick person or the like. For example, it may be desirable to place the sick person or the like temporarily on the floor 24. Rather, a bathtube may be arranged immediately under the side bars 10 and 11 in the state shown in FIGS. 4 and 5, so that the sick person or the like can be brought into the bathtub in an intermediate stage of downward movement of the side bars 10 and 11.

An operation reverse to the above may be carried out in order to return the sick person or the like onto the bed body 3.

In the aforementioned typical method of using the bed apparatus 1, the hanger members 61 may be replaced by the hammock 65 shown in FIG. 19.

When the support members 8 and 9 and the side bars 10 and 11 are not used, as shown in FIG. 6, it is preferable to cause the sliders 4 and 5 to slide further toward the bed body 3 while moving the upright bars 6 and 7 toward an end along the cross direction of the bed body 3. More preferably, the arms 29*a* and 30*a* are fixed in upwardly rotated states, to raise up the vertical positions of the side bars 10 and 11.

The aforementioned hammock 65 can be advantageously employed for helping the sick person or the like to defecate, or helping him into a wheelchair.

When the bed apparatus 1 is brought into the state shown in FIGS. 4 and 5 and the hanger members 61 are removed from the side bars 10 and 11 and the sick person or the like may stand between the side bars 10 and 11 for a walking exercise while gripping the side bars 10 and 11.

When the arms 29*a* and 30*a* are fixed in upwardly rotated states as shown in FIGS. 1 to 3 for raising up the vertical positions of the side bars 10 and 11 while a pulley is mounted on at least one of the side bars 10 and 11 and a rope passes around the pulley, the sick person or the like can exercise his hand(s) and/or feet in a condition lying on the bed body 3. More specifically, the person can grip both ends of the rope with the left and right hand respectively for alternately training the hands. Alternatively, the person can secure one end of the rope to the foot, grip the other end of the rope and move the hand for raising the foot, thereby exercising both the hand and the foot.

Figure 20:
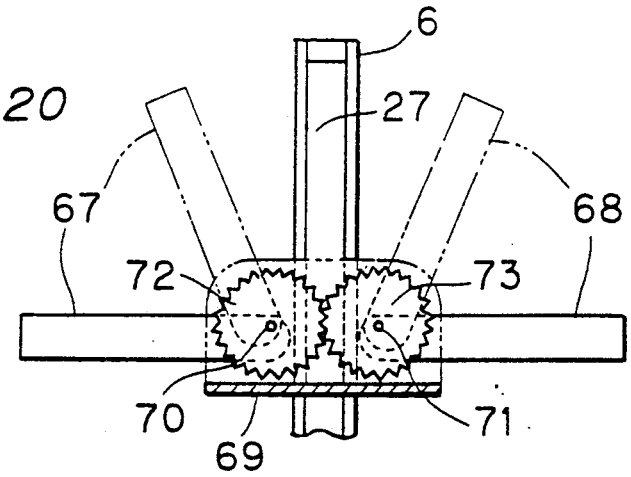
FIG. 20 shows another embodiment of the present invention, particularly with reference to side bar raising arms and a structure related thereto.
Figure 21:
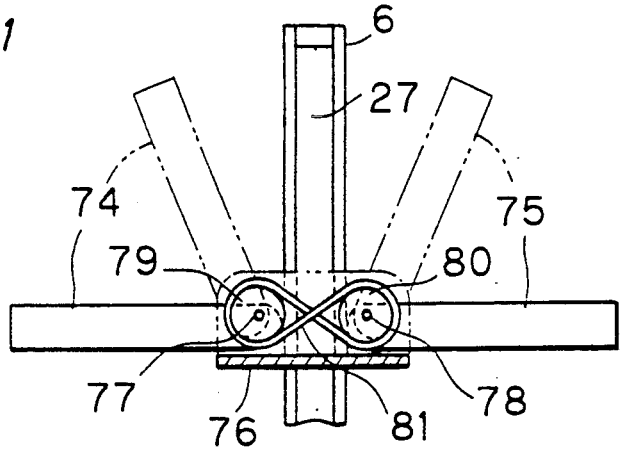
FIG. 21 shows still another embodiment of the present invention, particularly with reference to other side bar raising arms and a structure related thereto.
Figure 22:
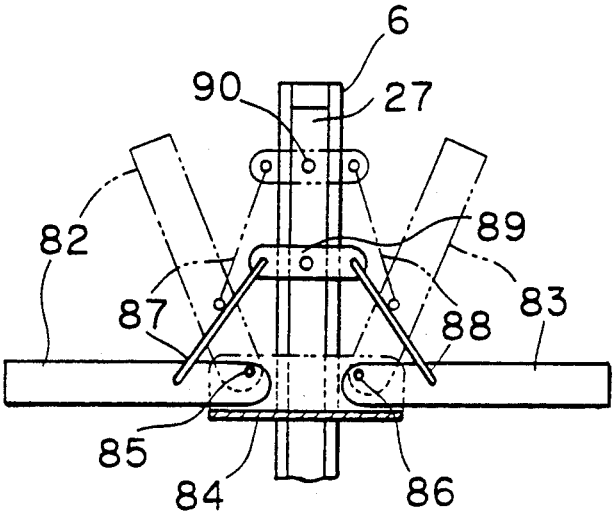
FIG. 22 shows a further embodiment of the present invention, particularly with reference to still another set of side bar raising arms and a structure related thereto.

FIGS. 20, 21 and 22 illustrate other embodiments of the present invention, with reference to pairs of arms which are interlocked in cooperation with other elements.

FIG. 20 shows a pair of arms 67 and 68, which are mounted on a bracket 69 to be rotated about pins 70 and 71. Similarly to the aforementioned embodiment, the bracket 69 is fixed to a sliding block 27.

Gears 72 and 73 are fixed to these arms 67 and 68 respectively. The gears 72 and 73 are rotatable about the pins 70 and 71 in unison with the arms 67 and 68, and fitted with each other. Therefore, when either one of the arms 67 and 68 is rotated upwardly as shown by phantom lines, the other one of the arms 67 and 68 is also rotated upwardly in response thereto.

In order to fix the upwardly rotated states of the arms 67 and 68, members such as the hook links 33 and 34 are used as disclosed in the aforementioned embodiment, for example. Such hook links may be replaced by key members, which can be caused to engage or disengage from the gears 72 and 73. The key members are fitted to the gears 72 and 73 for this purpose.

FIG. 21 shows a pair of arms 74 and 75, which are rotatably mounted by pins 77 and 78 to a bracket 76. Similarly to the aforementioned embodiments, the bracket 76 is fixed to a sliding block 27.

Pulleys 79 and 80 are fixed to the arms 74 and 75, to be rotated about the pins 77 and 78 in unison with the arms 74 and 75. A belt 81 runs around the pulleys 79 and 80 in cross-over fashion.

When either one of the arms 74 and 75 is rotated upwardly as shown by phantom lines, the other one of the arms 74 and 75 is also rotated upwardly in response thereto. In order to fix the upwardly rotated states, members such as the hook links 33 and 34 are employed similarly to the aforementioned embodiments.

FIG. 22 shows a pair of arms 82 and 83, which are mounted on the bracket 84 for rotation about pins 85 and 86 respectively. Similarly to the aforementioned embodiments, this bracket 84 is fixed to a sliding block 27.

Links 87 and 88 are rotatably mounted on the arms 82 and 83 respectively. These links 87 and 88 are rotatably coupled to a coupler 89, which is movable along the sliding block 27.

In such a structure, the coupler 89 is vertically movable along the sliding block 27, so as to rotate both arms 82 and 83 of the pair. In order to fix the upwardly rotated states of the arms 82 and 83 as shown by phantom lines, for example, a pin 90 is inserted to pass through the coupler 89 and the sliding block 27.

In the structure shown in FIG. 22, a compression spring may be arranged between the coupler 89 and the bracket 84, to regularly urge the arms 82 and 83 into the positions shown by the phantom lines.

Although the upright bars 7 and 8 are moved along the sliders 4 and 5 in association with the sliding movement of the sliders 4 and 5 in the embodiment described with reference to FIGS. 1 to 19, the operation of the sliders along the bed body may be carried out independently of the operation of the upright bars along the sliders.

Further, at least either the sliders or the upright bars may be manually moved. This also applies to the support members, which are moved along the upright bars.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A bed apparatus comprising: a bed body (3) having a longitudinal dimension and a cross-directional dimension; a pair of sliders (4, 5) mounted on both end portions of said bed body (3) for a sliding movement in the cross direction of said bed body (3), said sliders extending in the cross direction of said bed body (3); a pair of upright bars (6, 7), each upright bar being mounted on a respective one of said sliders (4, 5) to extend upwardly from said sliders (4, 5) and means for moving said upright bars horizontally along the cross direction of said bed body (3) relative to said sliders (4, 5); a pair of support members (8, 9) mounted to be movable vertically along said upright bars (6, 7) and means for stopping said support members in adjusted positions; and coupling bar means (10, 11) for coupling said pair of support members (8, 9) with each other.

2. The bed apparatus in accordance with claim 1, wherein said sliders (4, 5) comprise leg portions (12, 13) and wheels (14, 15) mounted on lower ends of said leg portions (12, 13) respectively.

3. The bed apparatus in accordance with claim 1, further comprising means for interlocking a sliding movement of said sliders (4, 5) relative to said bed body (3) with a movement of said upright bars (6, 7) relative to said sliders (4, 5).

4. The bed apparatus in accordance with claim 3, wherein said interlocking means comprises endless transmission means (18) arranged on each of said sliders (4, 5) for rotation, first means (22) for fixing a first position of said transmission means (18) relative to said bed body (3), and second means (25) for fixing a second position of said transmission means (18) opposite to said first position, relative to each of said upright bars (6, 7).

5. The bed apparatus in accordance with claim 4, wherein said transmission means comprises a chain (18).

6. The bed apparatus in accordance with claim 4, further comprising a motor (16) for driving said transmission means (18).

7. The bed apparatus in accordance with claim 1, wherein respective ones of said support members (8, 9) comprise sliding blocks (27, **27*a*) movable along said upright bars (6, 7), brackets (28, 28*a*) fixed to said sliding blocks (27, 27*a*), and pairs of arms (29, 30; 29*a*, 30*a*) oppositely extending from said brackets (28, 28*a*) along the cross direction of said bed body (3**).

8. The bed apparatus in accordance with claim 7, wherein said pairs of arms (29, 30; **29*a*, 30*a*) are upwardly rotatable with respect to said brackets (28, 28*a*), and said support members (8, 9) further comprise means (33, 34; 33*a*, 34*a*) for fixing upwardly rotated positions of said arms (29, 30; 29*a*, 30*a***).

9. The bed apparatus in accordance with claim 7, wherein said coupling bar means comprises two side bars (10, 11), which are mounted on said arms (29, 30; **29*a*, 30*a***) respectively.

10. The bed apparatus in accordance with claim 9, further comprising means for adjusting positions of said side bars (10, 11) on said arms (29, 30; **29*a*, 30*a***).

11. The bed apparatus in accordance with claim 7, wherein each of said sliding blocks (27, **27*a*) comprises a nut with a female screw threading, and each of said upright bars (6, 7) comprises a lead screw (46**) threaded through said nut with said female screw threading.

12. The bed apparatus in accordance with claim 11, further comprising a motor (49) for driving said lead screw (46).

13. The bed apparatus in accordance with claim 9, further comprising a plurality of hanger members (61) having hook portions (62) which are engageable with respective ones of said side bars (10, 11).

14. The bed apparatus in accordance with claim 13, wherein said hanger members (61) include plate-shaped portions which are bent to provide L-shaped sections.

* * * * *